US009770063B2

(12) United States Patent
Sartor

(10) Patent No.: US 9,770,063 B2
(45) Date of Patent: Sep. 26, 2017

(54) SPORTS BOOT WITH A COLLAR ARTICULATED FOR A WALKING POSITION

(75) Inventor: Paolo Sartor, Montebelluna (IT)

(73) Assignee: ROSSIGNOL LANGE S.R.L., Montebelluna (IT)

( * ) Notice: Subject to any disclaimer, the term of this patent is extended or adjusted under 35 U.S.C. 154(b) by 180 days.

(21) Appl. No.: 13/365,720

(22) Filed: Feb. 3, 2012

(65) Prior Publication Data

US 2012/0198725 A1 Aug. 9, 2012

(30) Foreign Application Priority Data

Feb. 3, 2011 (EP) ..... 11425022

(51) Int. Cl.
*A43B 5/04* (2006.01)

(52) U.S. Cl.
CPC ..... *A43B 5/0474* (2013.01); *Y10T 403/32254* (2015.01)

(58) Field of Classification Search
CPC ... A43B 5/0419; A43B 5/0415; A43B 5/0441; A43B 5/0417; A43B 5/0445; A43C 11/16
USPC ..... 36/117.4, 117.5, 117.7
See application file for complete search history.

(56) References Cited

U.S. PATENT DOCUMENTS

| | | | | |
|---|---|---|---|---|
| 3,793,749 | A * | 2/1974 | Gertsch et al. | 36/117.6 |
| 4,494,324 | A * | 1/1985 | Spademan | 36/117.5 |
| 4,691,454 | A * | 9/1987 | Ottieri | 36/118.9 |
| 4,761,899 | A * | 8/1988 | Marxer | 36/118.7 |
| 4,893,419 | A * | 1/1990 | Arieh et al. | 36/118.1 |
| 4,908,965 | A * | 3/1990 | Iwama | 36/118.1 |
| 5,020,822 | A * | 6/1991 | Wulf et al. | 280/613 |
| 5,048,204 | A * | 9/1991 | Tacchetto et al. | 36/50.5 |
| 5,136,794 | A * | 8/1992 | Stampacchia et al. | 36/118.7 |
| 5,412,883 | A * | 5/1995 | Wulf et al. | 36/50.5 |
| 5,702,119 | A * | 12/1997 | Challande et al. | 280/625 |
| 6,131,313 | A * | 10/2000 | Pierce et al. | 36/118.3 |
| 6,643,955 | B2 * | 11/2003 | Pierce et al. | 36/118.3 |
| 6,892,429 | B2 * | 5/2005 | Sartor et al. | 24/712.6 |
| 7,963,050 | B2 * | 6/2011 | Sartor et al. | 36/118.7 |
| 8,132,343 | B2 * | 3/2012 | Bollard et al. | 36/118.7 |
| 2005/0016027 | A1 * | 1/2005 | Trinkaus et al. | 36/115 |
| 2009/0178304 | A1 * | 7/2009 | Bollard et al. | 36/118.2 |

FOREIGN PATENT DOCUMENTS

| | | |
|---|---|---|
| EP | 0 248 149 A | 12/1987 |
| EP | 0 740 909 A | 11/1996 |
| EP | 0 940 096 A | 9/1999 |

(Continued)

OTHER PUBLICATIONS

Search report and written opinion issued by European Patent Office in priority application EP 11425022 dated Jun. 24, 2011.

*Primary Examiner* — Megan Brandon
(74) *Attorney, Agent, or Firm* — Huag Partners LLP

(57) ABSTRACT

A locking and unlocking device (10) for forming an interface between the shell (1) and the collar (2) of a sports boot, which comprises a rocker (11) that is movable in rotation about a pin (13), a lever (15) that is movable in rotation and an elastic element connected to the lever (15), such that the lever (15) is able to occupy a first stable position, in which it holds the rocker (11) in a locking position, and a second stable position, in which it holds the rocker (11) in an unlocking position.

20 Claims, 3 Drawing Sheets

(56) References Cited

FOREIGN PATENT DOCUMENTS

| | | | |
|---|---|---|---|
| EP | 1 952 713 | A | 8/2008 |
| EP | 1952713 | A1 * | 8/2008 |
| EP | 2 070 433 | A | 6/2009 |
| FR | 2 661 076 | A | 4/1991 |

* cited by examiner

SPORTS BOOT WITH A COLLAR ARTICULATED FOR A WALKING POSITION

BACKGROUND OF THE INVENTION

The invention relates to a sports boot in the form of a rigid upper composed of a collar articulated on a shell surrounding the foot, which is provided with a device for locking or blocking the collar on the shell in order to lock or block the collar relative to the shell in a first position for practicing the sport and for unlocking the collar relative to the shell and allowing the amplitude of movement thereof relative to the shell to be increased in a second position when the sport is not being practiced, for example in order to make it easier to put the boot on the foot and to walk. The invention also relates to a device for locking and unlocking a collar on a shell as such for a sports boot.

DESCRIPTION OF THE PRIOR ART

Document FR2661076 discloses various prior-art solutions for such locking devices, as applied to ski boots.

According to a first solution, the device for locking the collar on the shell rests on a rocker positioned on the collar and interacting with a shell stop, the operation of which is controlled by a boot-opening buckle by means of a linking cable. When the skier wishes to rest or to walk, he releases the boot buckle, which has the effect of relaxing traction on the cable, which gives rise to a change in position of the rocker through the effect, in particular, of a spring, in order to unlock the collar and allow a rotation thereof as far as a position close to the vertical, which makes walking more comfortable, to a position of rest and one in which the boot can be put on and taken off. The drawback of this solution arises from the fact that unlocking of the collar relies on a relaxing of the cable, the effect of which is often insufficient to actuate unlocking. The skier sometimes has manually to assist the mechanism by applying force to the boot in order to achieve the unlocked position. Furthermore, existing mechanisms are complex and expensive and do not allow transformation of the significant travel of the cable into a small degree of travel of the rocker. For all these reasons, this first solution is unsuitable.

Document EP2070433 describes another solution, which relies on a cam follower mounted in rotation on the boot about a first pivot, which may be actuated by a lever mounted in rotation relative to the cam follower about a second pivot and which interacts with the boot via a cam surface in such a manner as to entrain the cam follower in rotation in order to change or block the positioning thereof and to achieve the two positions of either locking or unlocking the boot. This solution presents the drawback of being complex, since it requires numerous components arranged in a complicated manner, and needs two rotation pins. Furthermore, manual actuation thereof is not user-friendly since variable force has to be exerted, depending on the relative position of the collar, and said force may be considerable if the collar is inclined rearward and against release of the cam follower.

SUMMARY OF THE INVENTION

A general subject matter of the present invention is a solution, for locking/unlocking the collar on the shell of a sports boot, which does not have the prior-art drawbacks.

More precisely, a first subject matter of the present invention is a solution for locking/unlocking the collar on the shell of a sports boot, which functions in a highly effective manner.

A second subject matter of the present invention is a solution for locking/unlocking the collar on the shell of a sports boot, the mechanism of which is simple, compact and inexpensive.

The invention is based on a solution that combines a rocker and a lever, subject to the action of an elastic element.

The invention is more precisely defined by the claims.

DESCRIPTION OF THE DRAWINGS

The subject matter, features and advantages of the present invention will be set forth in detail in the following description of a particular embodiment given in a non-limiting manner in connection with the attached figures, among which.

DESCRIPTION OF THE PREFERRED EMBODIMENT

The invention will be described as it applies to a ski boot. It could, however, apply to any sports boot with a rigid upper, i.e. an upper that comprises a collar that can move relative to a shell, and which is made substantially from a material that is at least as rigid as a polyurethane of 40 shore D hardness.

Figure 1:
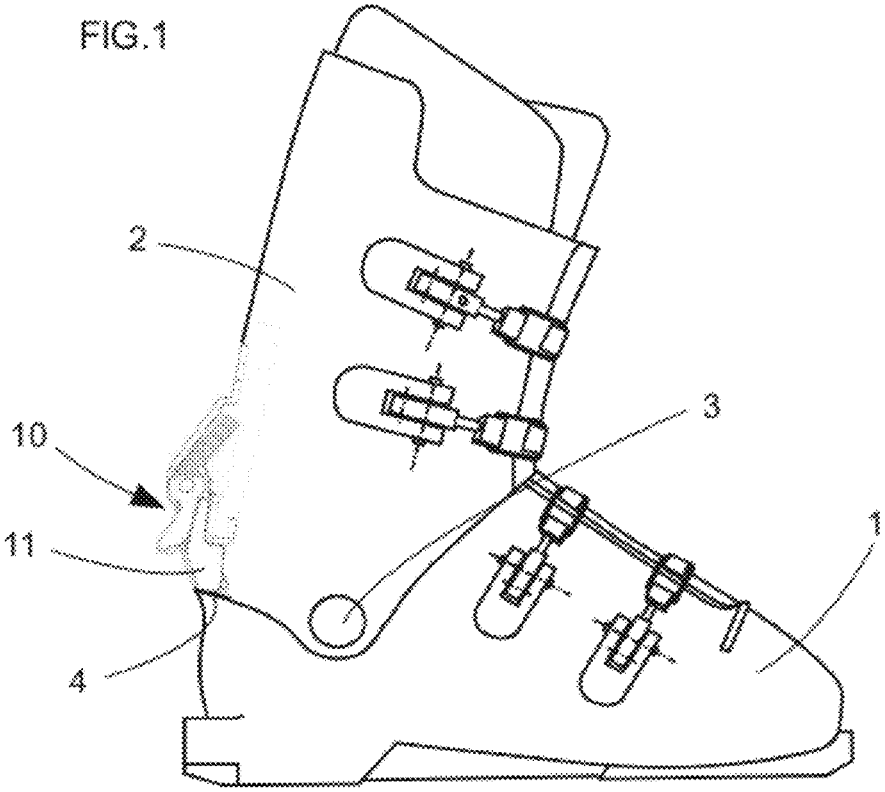
FIG. 1 is a side view of a ski boot that incorporates a locking and unlocking device in a locked position, according to a first embodiment of the invention.

FIG. 1 shows a ski boot according to the embodiment of the invention, which comprises a collar 2 mounted so as to be movable in rotation relative to a shell about a pin 3. Furthermore, it comprises, in its rear part, a locking/unlocking device 10 represented roughly in FIG. 1 in order to facilitate comprehension thereof and, more particularly visible in FIG. 2, which comprises a rocker 11 that is able to interact with a stop 4 of the shell 1.

In a first, so-called "locking position", the rocker 11 is held so as to bear against the surface of the boot and interacts with the stop 4 of the shell, thereby preventing any rearward rotation of the collar 2 relative to the shell 1. This position of locking or blocking the collar of the boot is that envisaged for skiing. In a second, so-called "unlocking position", the rocker 11 is held away from the surface of the boot and no longer abuts against the stop 4, thereby allowing greater rotation of the collar 2 relative to the shell 1, and in particular a rearward tilt. This boot unlocking position is, in particular, envisaged for walking.

Figure 2:
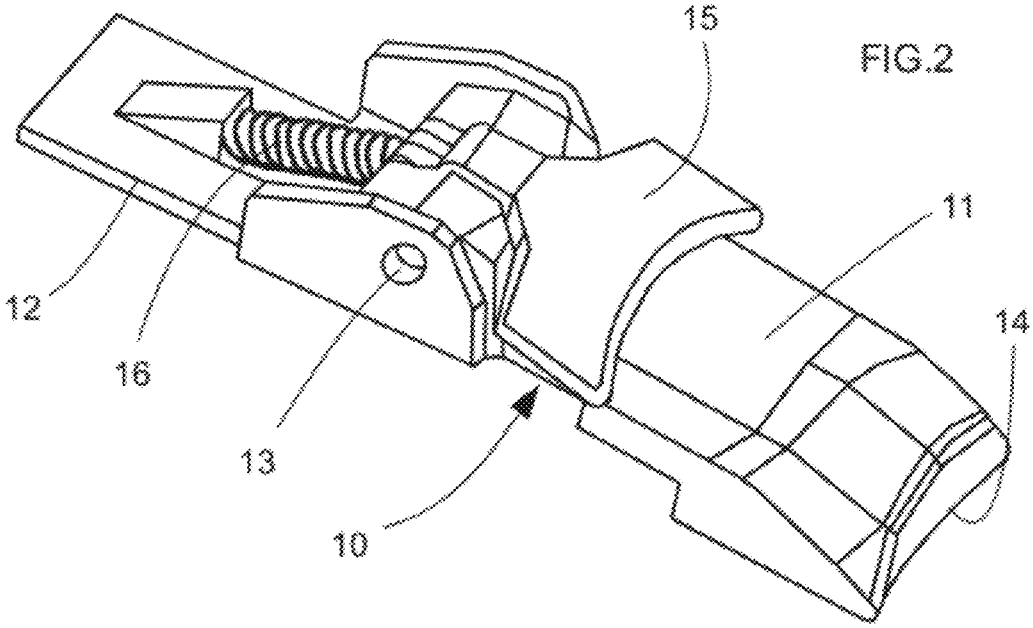
FIG. 2 is a perspective view of the locking and unlocking device in a locked position, according to the embodiment of the invention.
Figure 3:
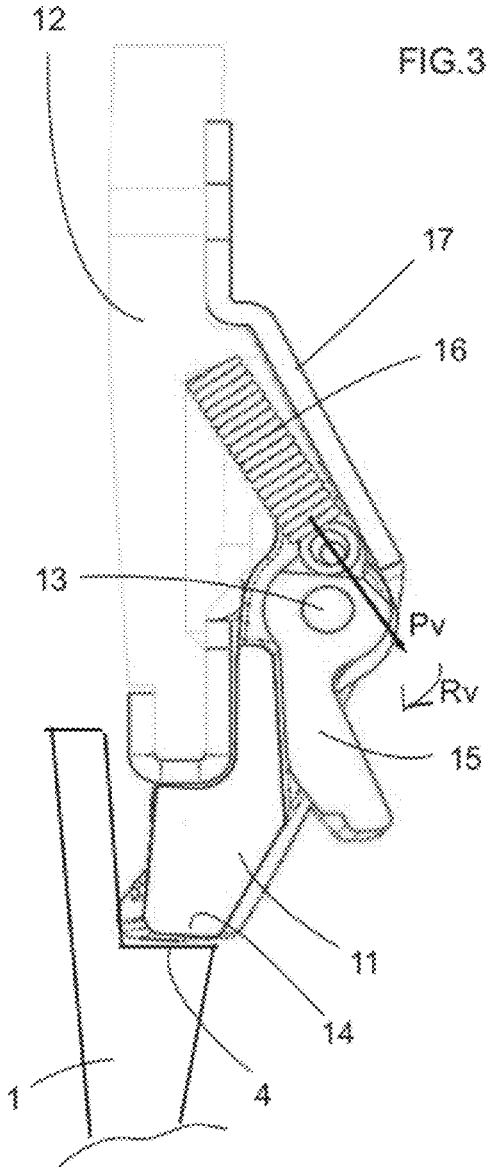
FIG. 3 is a side view of the locking and unlocking device in a locked position according to the embodiment of the invention.

FIGS. 2 and 3 illustrate the locking and unlocking device 10 of the boot according to the embodiment, in a locking position. It comprises a baseplate 12 designed to be fastened to the boot. In this embodiment, the baseplate 12 is fastened to the collar 2 of the boot. A rocker 11 is mounted so as to be movable in rotation about a pin 13, fixed on this baseplate 12 and positioned in the upper part of the rocker. The pin 13 is substantially parallel to the baseplate 12, i.e. to the surface of the boot. The rocker 11 further comprises a surface 14 toward the lower end thereof, which is designed to interact with the stop 4 of the boot in order to implement the locking function. Furthermore, a lever 15 is mounted so as to be movable in rotation about the same pin 13. Lastly, a linear spring 16, working in compression, comprises a first end fastened on the baseplate 12 or simply bearing in a recess in the baseplate 12 and a second end fastened on the lever 15. A cover 17 covers part of the device, in particular the spring 16, in order to protect it from adverse external conditions and at the same time to give the device an attractive esthetic appearance.

A explanation will now be given of the way in which this locking and unlocking device 10 of the boot functions.

In the locking position, the surface 14 of the locker 11 remains bearing against the stop 4 of the shell and prevents any rearward rotation of the collar 2. In order to change the configuration of the locking/unlocking device, a user grasps the lever 15 and rotates it about the pin 13, in a direction that moves it away from the surface of the boot.

In a first phase of this rotation, the user has to overcome the contrary force exerted by the spring 16, which is represented by the arrow Pv (locking pressure), which acts on the lever and tends to rotate it in the direction represented by the arrow Rv (locking rotation), i.e. tending to hold the lever 15 in its initial, locked, position, which is thus a stable position. Beyond a certain threshold angle of rotation of the lever 15, which corresponds to a position in which the spring thrust force is aligned with the rotation pin 13 of the lever, the thrust force of the spring 16 passes to the other side of the rotation pin 13 of the lever and the spring 16 then exerts a force that rotates the lever in a opposite direction, and thus in the direction required by the user. This force is represented by the arrow Pd (unlocking pressure) in FIG. 4, acting on the lever and tending to rotate it in the direction represented by the arrow Rd (unlocking rotation), counter to the locking rotation direction.

Figure 4:
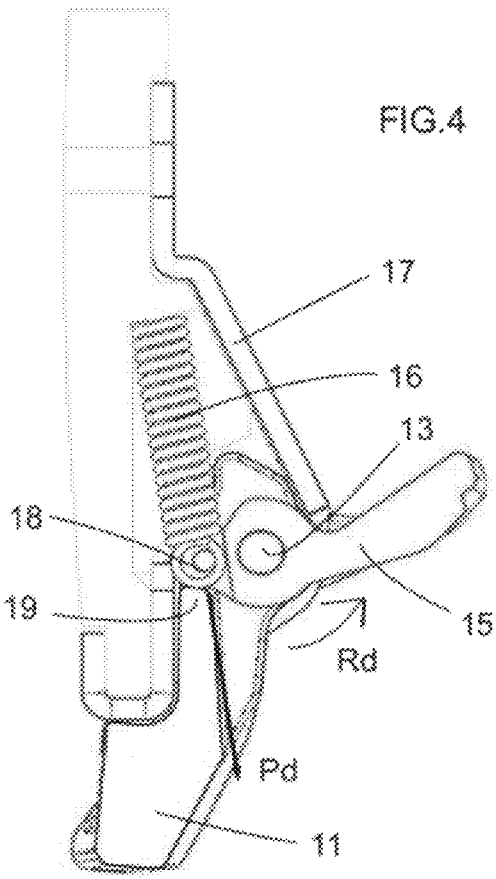
FIG. 4 is a side view of the locking and unlocking device in an intermediate, unlocking, position, according to the embodiment of the invention.
Figure 5:
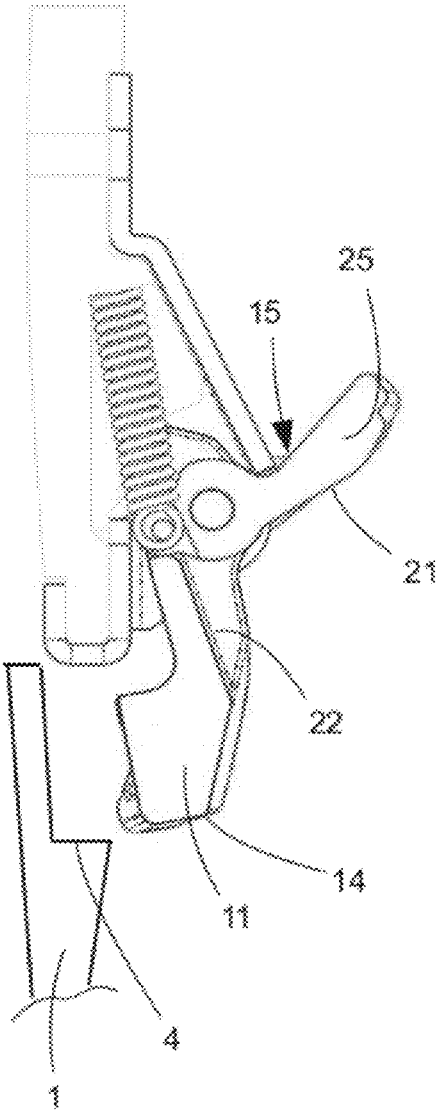
FIG. 5 is a side view of the locking and unlocking device in an unlocked position, according to the embodiment of the invention.

FIG. 4 illustrates an intermediate configuration of this unlocking phase, in which a protuberance 18 of the lever 15, on which the spring 16 is, moreover, fastened, abuts on an upper surface 19 of the rocker 11. From this position, continued rotation of the lever 15 gives rise to a thrust on the rocker 11 at the point of contact between the protuberance 18 and the upper surface 19 of the rocker 11, which rotates the rocker 11 about the pin 13 as far as moving it away from the wall of the boot, as shown in FIG. 5, which corresponds to the locked position of the device. This unlocking phase thus comprises rotation of the lever 15 at an angle slightly greater than 90°, until it abuts against the cover 17.

Incidentally, throughout the second part of the rotation of the lever 15, beyond the threshold mentioned previously, the spring 16 exerts a force that assists the user in unlocking the locking and unlocking device, and is even sufficient for this action to become automatic and no longer to require user involvement.

Conversely, changing from the unlocked position to the locked position requires the actuation of the lever 15 in rotation in the other direction. In a first phase, a user has to exert a force to overcome the contrary force exerted by the spring 16, which tends to hold the lever in the unlocking position, which is thus a stable position. Beyond a limit angle, the force exerted by the spring 16 tends to rotate the lever 15 toward the locking position and assists the user and even replaces the latter, allowing automatic or semi-automatic rotation of the lever 15.

Figure 6:
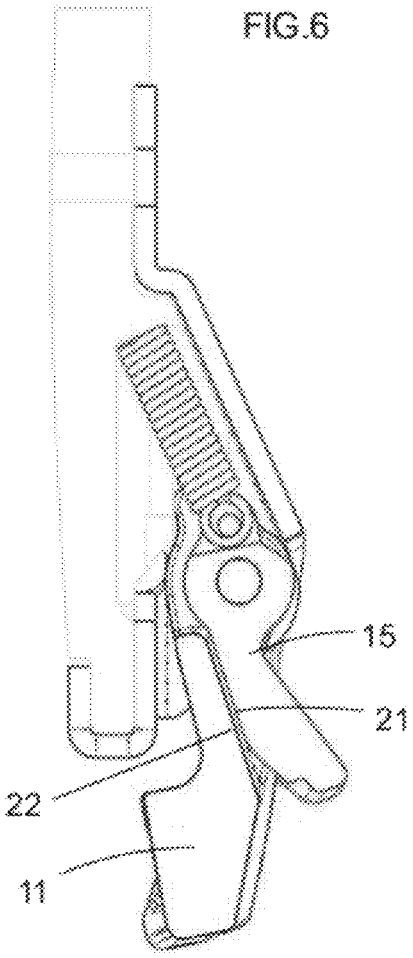
FIG. 6 is a side view of the locking and unlocking device in an intermediate, locking, position according to the embodiment of the invention.

FIG. 6 shows an intermediate phase in this rotation, in which a surface 21 of the lever comes into contact with a surface 22 of the rocker 11, in such a manner as to exert a thrust force on the rocker that rotates the latter as far as its locking position illustrated in FIG. 3.

Incidentally, this device allows partial decoupling of the lever 15 and of the rocker 11. Indeed, in each initial phase of actuation of the lever 15, starting from one of the two stable positions, rotation thereof is actuated independently of the rocker 11, with no effect on the rocker 11. The device thus allows actuation of the lever 15 to be dissociated from the boot blocking function directly implemented by the rocker. In other words, the actuating lever 15 is at least partially free to move relative to the rocker such that the force for actuating this lever is independent of any forces exerted by the boot on the rocker. This offers the advantage that a user always has to exert the same force on the lever 15 during actuation thereof, with no impact from any such forces exerted by the collar and/or the shell of the boot on the rocker 11. In a variant embodiment, this decoupling could affect the start of actuation of the lever only from one of its two stable positions. Furthermore, the amplitude of its rotational movement independent of the rocker could assume any other value.

What is more, the spring 16 exerts a force on the device and allows its automatic positioning in the desired configuration, possibly with a delay in its final configuration if the relative position of the collar and the boot shell temporarily prevents the rocker of the locking and unlocking device from reaching its final position.

This situation may, for example, arise if, in the course of the locking phase, the collar occupies too rearward a position, preventing rotation of the rocker as far as its stop position on the shell. On the other hand, as soon as the collar is turned forward relative to the shell, in such a manner as to free up sufficient space between the collar and the shell in the rear part of the boot, the rocker 11 immediately reaches its final position through the force of the stress exerted by the spring, in the locked position abutting against the stop 4 of the shell, in which it limits the movement of the collar.

Similarly, this situation may, for example, arise if, in the course of the unlocking phase, the collar occupies too rearward a position and exerts a bearing force on the rocker, preventing rotation thereof, owing to its rubbing on the shell, which does not allow it to be released to its stop position. On the other hand, as soon as the collar is turned forward relative to the shell, the rocker 11 immediately reaches its final unlocked position, away from the shell, shown in FIG. 5, through the effect of the stress exerted by the spring.

The spring thus enables the locking and unlocking device to occupy two stable positions, as explained above. Its action on the lever represents a toggle-type system.

Ultimately, this solution achieves the aims sought and provides the following advantages:

- locking and unlocking is highly effective through the action of sufficient elastic force to maintain the two positions of the device in a stable manner;
- changing the position of the device is user-friendly because it is assisted and includes an automatic phase;
- actuation of the device is likewise user-friendly because the lever rotates in the same direction as the rocker, which enables a user naturally and intuitively to manipulate the lever in the correct direction;

the mechanism is simple, inexpensive and compact because there is a small number of components of compact format.

Naturally, the invention is not restricted to the embodiment described and a number of variant embodiments thereof are possible.

First, the locking and unlocking device may function differently, be fastened to the shell and abut on the collar in order to fulfill the locking function, in the opposite manner from the embodiment shown in FIG. 1.

Moreover, the spring may have any orientation other than that illustrated, in which case it has a variable inclination between the two end positions of the device, which remains less than 30° relative to a vertical direction. It could, for example, approximate a horizontal direction, and have a variable inclination of less than 30 degrees relative to a horizontal direction. Lastly, it could have any inclination relative to the baseplate or to the boot and any amplitude of movement between the locked and unlocked positions of the device of less than 30 degrees. Furthermore, the intrinsic properties thereof, and also the compression thereof in the locked position, are defined in order to achieve a happy compromise between the stability of the locked and unlocked positions and the manual force required to change position. Incidentally, this linear compression spring could likewise have a curved configuration owing to the significant compression once exerted thereon, without modifying the mode of operation explained previously. In a variant embodiment, this spring could work in traction, between a fixed link with the boot, possibly by means of a baseplate, and a link with the lever of the device. According to a further variant embodiment, it is possible to install a device adjusting the force required to manipulate the lever by rending the end of the spring fixed on the baseplate movable by any means. Naturally, the spring may be replaced by any equivalent elastic element, such as a torsion spring, an elastic flexing leaf spring, or a flexible, elastic component made, for example, from viscoelastic material working in compression.

Secondly, the lever has been presented as comprising a first part that is substantially cylindrical about an axis of rotation, comprising a fastening element for the spring and a bearing surface on the rocker, and a second, elongate, part forming a manual actuation arm 25. In a variant embodiment, this arm may be much shorter, or even eliminated altogether, in order to make the overall assembly more compact. To that end, a simple string or cable or strap, or any flexible element, may be fastened on the lever in order to allow rotation thereof by simply pulling on this flexible element. In a variant embodiment, a screwdriver-type tool may be used to rotate the lever.

Furthermore, the lever and the baseplate have been described as being movable in rotation about the same axis, which is a simple solution. However, in a variant embodiment, they may be movable in rotation about two different axes.

Lastly, the locking and unlocking device may be further simplified by removing the baseplate thereof, for example, and fastening the components directly on the boot. Moreover, the cover likewise be dispensed with.

The invention claimed is:

1. A locking and unlocking device for forming an interface between a shell and a collar of a sports boot, the device comprising:

a rocker that is, in an upper part, movable in rotation about a pin in a static location relative to the collar of the sports boot, the rocker including a surface toward a lower end that is configured to interact with a stop on the shell of the boot, a lever that is distinct from the rocker and mounted about the same pin as the rocker, adapted to be directly fixed on the collar of the sports boot, the lever movable in rotation relative to both said pin and the collar on which the lever is adapted to be mounted, to change a configuration of the rocker from a locking position to an unlocking position, and an elastic element comprising a first end directly fastened on the lever and a second end fastened on the collar of the sports boot, such that the lever is able to occupy a first stable position, in which the lever holds the rocker in the locking position, and a second stable position, in which the lever holds the rocker in the unlocking position.

2. The locking and unlocking device as claimed in claim 1, wherein the elastic element is more compressed when the lever is in the locking position than when the lever is in the unlocking position.

3. The locking and unlocking device as claimed in claim 1, wherein the lever and the rocker are movable in the same direction of rotation in the course of the two phases of locking and unlocking the locking and unlocking device.

4. The locking and unlocking device as claimed in claim 1, wherein an end of the elastic element is fastened to the lever in a position away from the pin of the lever, in such a manner as to exert a moment of inertia on the lever, tending to hold the lever in the two, locking and unlocking, positions.

5. The locking and unlocking device as claimed in claim 4, wherein the elastic element exerts a moment of inertia, tending to rotate the lever in two opposite directions in the two stable positions of the lever.

6. The locking and unlocking device as claimed in claim 1, wherein the lever comprises two surfaces for acting on two corresponding surfaces of the rocker.

7. The locking and unlocking device as claimed in claim 1, wherein the elastic element is a linear spring working in compression.

8. The locking and unlocking device as claimed in claim 7, wherein the spring has an amplitude of inclination of less than 30 degrees between the two stable positions of the lever.

9. The locking and unlocking device as claimed in claim 1, wherein the rocker has a surface toward one end that occupies a first position suitable for stopping against a stop of a boot in the locking position thereof and a second position suitable for release from the stop of the boot in the unlocking position thereof.

10. The locking and unlocking device as claimed in claim 1, which comprises at least one of a cover for concealing at least a part of the elastic element and a baseplate for fixing the rotation pin of the rocker.

11. A sports boot that comprises a shell adapted to surround a foot of a user and a collar articulated on the shell, which comprises a locking and unlocking device arranged in a rear part thereof as interface between the shell and the collar in order to reduce or to eliminate freedom of movement of the collar relative to the shell in the locking position thereof, wherein the locking and unlocking device comprises:

a pin in a static location relative to the collar, a rocker that is, in an upper part, mounted in rotation about said pin directly fixed on the collar, the rocker including a surface toward a lower end that is configured to interact with a stop on the shell of the sports boot, a lever that is distinct from the rocker and is mounted about the same pin as the rocker, directly fixed on the collar, to change a configuration of the rocker from a locking position to an unlocking position, and an elastic element comprising a first end directly fastened on the lever and a second end fastened on the collar, such that the lever is able to occupy a first stable position, in which the lever holds the rocker in the locking position, and a second stable position, in which the lever holds the rocker in the unlocking position.

12. The sports boot as claimed in claim 11, wherein the rocker occupies a position in which the rocker is against a rear surface of the shell of the boot so that a surface remains stopped on a stop of the shell of the boot in the locking position thereof and a position away from the surface of the shell of the boot in the unlocking position thereof.

13. The sports boot as claimed in claim 11, wherein the lever has a manual activation arm that occupies a position close to a surface of the boot in a first stable position and a position substantially perpendicular to the surface of the boot in a second stable position.

14. The sports boot as claimed in claim 12, wherein the lever has an arm that occupies a position close to a surface of the boot in its first stable position and a position substantially perpendicular to that surface in its second stable position.

15. The locking and unlocking device as claimed in claim 1, wherein a protuberance of the lever abuts on a surface of the rocker to move the rocker away from the boot and rotate the rocker into the unlocking position.

16. The locking and unlocking device as claimed in claim 1, wherein a surface of the lever comes into contact with a surface of the rocker to rotate the rocker into the locking position.

17. The locking and unlocking device of claim 1, wherein the lever includes an activation arm configured to be operable by a user of the sports boot.

18. The sports boot of claim 11, wherein the lever includes an activation arm configured to be operable by a user of the sports boot.

19. The locking and unlocking device as claimed in claim 1, wherein the elastic element has a first inclination angle relative to the collar in the locking position, and wherein the elastic element has a second inclination angle relative to the collar in the unlocking position, the first and second inclination angles being different.

20. The sports boot of claim 11, wherein the elastic element has a first inclination angle relative to the collar in the locking position, and wherein the elastic element has a second inclination angle relative to the collar in the unlocking position, the first and second inclination angles being different.

* * * * *